US006948953B2

(12) United States Patent
Fukamachi

(10) Patent No.: US 6,948,953 B2
(45) Date of Patent: Sep. 27, 2005

(54) CONNECTOR CONNECTING CONSTRUCTION AND A CONNECTOR CONNECTING METHOD

(75) Inventor: Makoto Fukamachi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/833,664

(22) Filed: Apr. 28, 2004

(65) Prior Publication Data

US 2004/0219809 A1 Nov. 4, 2004

(30) Foreign Application Priority Data

Apr. 30, 2003 (JP) ..... 2003-124805

(51) Int. Cl.[7] ..... H01R 13/44
(52) U.S. Cl. ..... 439/137; 439/310; 439/342
(58) Field of Search ..... 439/135–137, 439/342, 347, 138, 310, 259, 157

(56) References Cited

U.S. PATENT DOCUMENTS 4,791,608 A * 12/1988 Fushimoto ..... 439/137
5,848,902 A * 12/1998 Yamaguchi et al. ..... 439/342
5,967,808 A * 10/1999 Kubota ..... 439/310
6,093,040 A * 7/2000 Kodama et al. ..... 439/310
6,217,363 B1 4/2001 Takata
6,428,340 B2 * 8/2002 Okabe et al. ..... 439/347

* cited by examiner

*Primary Examiner*—Tho D. Ta
*Assistant Examiner*—Felix O. Figueroa
(74) *Attorney, Agent, or Firm*—Gerald E. Hespos; Anthony J. Casella

(57) ABSTRACT

A female connector (10) is assembled with a holder (20) on a dashboard (A) and a male connector (30) is assembled with an instrument panel (B). The male connector (30) has a receptacle 32 with a cut-out (35) for receiving the female connector (10). Guide pins (11) of the female connector (10) slide along guide grooves (25) of the holder (20) to displace the female connector (10) normal to an assembling direction and to connect the female connector (10) with the male connector (30). A movable protecting portion (40) is displaced from a protecting position where the movable protecting portion (40) covers the cut-out (35) to a retracted position RP where the movable protecting portion (40) is retracted from the cut-out (35) by sliding movements of guide pins (42) of the movable protection portion (40) along guide grooves (29) of the holder (20).

11 Claims, 12 Drawing Sheets

CONNECTOR CONNECTING CONSTRUCTION AND A CONNECTOR CONNECTING METHOD

BACKGROUND OF THE INVENTION

1. Field of the Invention

The invention relates to a connector connecting construction and to a connector connecting method.

2. Description of the Related Art

U.S. Pat. No. 6,217,363 and FIG. 11 herein relate to a connector connecting construction e.g. for connecting male and female connectors on an instrument panel and a dashboard of a vehicle body simultaneously with the assembly of the instrument panel and the dashboard. FIG. 11 shows a dashboard 1 and a male connector 2 laid on the outer surface of the dashboard 1. The male connector 2 has male terminals 2*a* and a forwardly open receptacle 2*b* that surrounds the male terminals 2*a*. A cut-out 2*c* is formed at the front half of a lower part of the receptacle 2*b*. FIG. 11 also shows an instrument panel 3 and a holder 4 fixed to the outer surface of the instrument panel 3. The holder 4 is formed with a guide groove 4*a*. A female connector 5 is mounted on the holder 4 and is configured to fit in the receptacle 2*b* of the male connector 2. The female connector 5 has a guide pin 5*a* that fits slidably in the guide groove 4*a* of the holder 4. The instrument panel 3 is assembled vertically with the dashboard 1 in the shown example. Thus, the female connector 5 enters the receptacle 2*b* through the cut-out 2*c* and is pushed down by the ceiling of the receptacle 2*b*, as shown in FIG. 12. The female connector 5 then is moved horizontally in the receptacle 2*b* and is connected by the sliding movement of the guide pin 5*a* along the guide groove 4*a*.

External matter can enter the receptacle 2*b* through the open front of the receptacle 2*b* or through the cut-out 2*c* before completing the connection. Such external matter can interfere with and damage the male terminals 2*a*. Damage to the male terminals 2*a* can be avoided by elongating the receptacle 2*b* and relocating the rear end of the cut-out 2*c* at a more forward position. However, this disadvantageously leads to a larger connection stroke of the connectors and longer connectors.

The invention was developed in view of the above problems and an object thereof is to protect a connecting portion without elongating a receptacle.

SUMMARY OF THE INVENTION

The invention relates to a connector connecting construction with first and second assembling members that can be assembled together. The first assembling member has a first connector and the second assembling member has a second connector that is connectable with the first connector. The second connector has a receptacle extending at an angle to an assembling direction of the assembling members and has at least one cut-out for permitting the first connector to enter the receptacle and to contact an inner surface of the receptacle in an assembling process. A connecting portion projects into the receptacle and is electrically connectable with the first connector. The first connector is to be assembled with a holder fixed to the first assembling member. Additionally, the first connector is pushed by the inner surface of the receptacle in the assembling process and is displaceable with respect to the second connector at an angle to the assembling direction by connector guiding means. A movable protecting portion is assembled with the second connector for at least partly covering the cut-out. The movable protecting portion and/or the holder comprise protecting-portion guiding means for displacing the movable protecting portion from a protecting position where the movable protecting portion at least partly covers the cut-out to a retracted position where the movable protecting portion is retracted from the cut-out to permit entry of the first connector through the cut-out as the assembling members are assembled.

The movable protecting portion is assembled on the second connector at the protecting position to cover the cut-out and to protect the connecting portion inside the receptacle. However, the protecting-portion guiding means displaces the movable protecting portion to the retracted position when the two assembling members are assembled. Thus, the first connector can enter the receptacle through the cut-out. The first connector then contacts the inner surface of the receptacle, and the connector guiding means displaces the first connector at an angle to the assembling direction with respect to the second connector. As a result, the two connectors are connected and the connecting portion is electrically connected with the first connector.

The movable protecting portion is retractable in the assembling process. Thus, the receptacle can be shorter as compared to a case where the receptacle is elongated to protect the connecting portion. Thus, a connection stroke of the connectors can be shorter and the connectors can be smaller.

The protecting-portion guiding means preferably comprises at least one guide pin on the movable protecting portion and at least one guide groove in the holder. The guide pin slides along the guide groove to displace the movable protecting portion between the protecting position and the retracted position. The guide pin engages the second connector to prevent the movable protecting portion at the protecting position from being displaced toward a side opposite from the retracted position. The guide pin performs two functions, namely, displacing the movable protecting portion and holding the movable protecting portion. Thus, the construction can be simplified.

At least one resilient locking means preferably is provided on the movable protecting portion and/or the second connector for preventing the movable protecting portion at the protecting position from being displaced toward the retracted position. The resilient locking means may be a semi-locking construction so that the locked state is canceled in response to a force of a specified intensity or higher. Thus, the locked state achieved by the resilient locking means is canceled automatically and the movable protecting portion is displaced to the retracted position.

Shake preventing means preferably are provided on the holder and/or the second connector to suppress the shake of the second connector with respect to the holder during the assembling process. Accordingly, the connection process is smoother.

A moving distance of the first connector along a direction arranged at an angle to the assembling direction preferably corresponds to a connection or separation stroke of the two connectors.

The invention also relates to a method of connecting a connector. The method comprises assembling a first connector with a holder fixed to a first assembling member via a connector guiding means. The method then includes providing a second assembling member with a second connector. The method proceeds by inserting the first connector through a cut-out of the second connector and into a receptacle of the second connector. The holder is displaceable with respect to the second connector at an angle to the assembling direction of the two assembling members and is pushed by an inner surface of the receptacle in the assembling process. The method also includes at least partly covering the cut-out by a movable protecting portion assembled with the first connector, and then displacing the movable protecting portion to a retracted position where the movable protecting portion is retracted from the cut-out portion. Thus, the first connector enters the receptacle through the cut-out as the two assembling members are assembled.

The movable protecting portion displacing step preferably comprises a step of guiding the movable protecting portion between the protecting position and the retracted position by means of at least one guide pin on the movable protecting portion and at least one guide groove in the holder. The guide pin preferably can prevent the movable protecting portion located at the protecting position from being displaced towards a side opposite from the retracted position by being engaged with the second connector.

These and other features of the invention will be more apparent upon reading of the following detailed description and accompanying drawings. It should be understood that even though embodiments are separately described, single features thereof may be combined to additional embodiments.

DETAILED DESCRIPTION OF THE PREFERRED EMBODIMENTS

A preferred embodiment of the invention is described with reference to FIGS. 1 to 10. This embodiment illustrates a construction for assembling a meter module of an automotive vehicle. More particularly, a female connector 10 on a dashboard A of a vehicle body and a male connector 30 on an instrument panel B are connected as the dashboard A and the instrument panel B are assembled. In the following description, reference is made to FIG. 1 concerning vertical and transverse directions.

Figure 1:
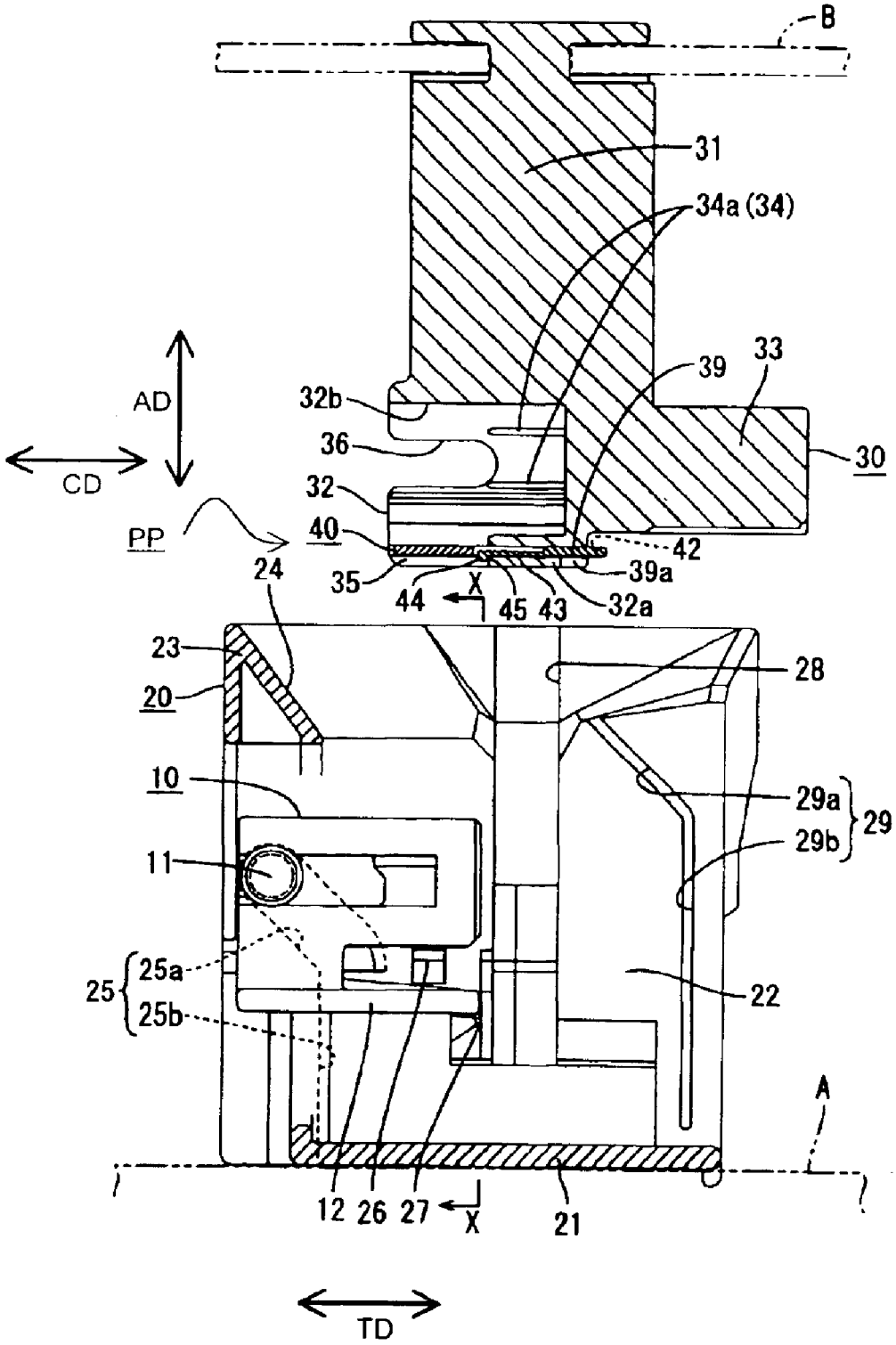
FIG. 1 is a side view in section showing a state before male and female connectors according to the invention are connected.

A holder 20 is fixed to a surface of the dashboard A facing the instrument panel B as shown in FIG. 1, and the female connector 10 is mounted laterally into the holder 20. As shown in FIGS. 1, 5 to 7, the female connector 10 is a wide block and female terminal fittings (not shown) connected with wires (not shown) are accommodated in the female connector 10. Substantially cylindrical guide pins 11 project sideways from left ends of each of the opposite outer side surfaces of the female connector 10 and a holding portion 12 bulges out sideways at the bottom end of the female connector 10.

The holder 20 has a bottom wall 21 and sidewalls 22 project from the opposite ends of the bottom wall 21. A bridging wall 23 couples left upper ends of the opposite sidewalls 22. The female connector 10 is mounted while being held closely between the opposite sidewalls 22. A guiding slanted surface 24 is formed at the upper ends of the sidewalls 22 and the inner surface of the bridging wall 23 for guiding the entrance of a mating male connector 30 into the holder 20. Each sidewall 22 has a guide groove 25 and the guide pins 11 of the female connector 10 are inserted into the corresponding guide grooves 25. An oblique area 25*a* is defined at an upper part of each guide groove 25 and extends oblique to a vertical assembling direction AD of the instrument panel B and the dashboard A. A straight area 25*b* is defined at a lower part of each guide groove 25 and extends substantially straight along the vertical assembling direction AD.

The female connector 10 is displaced obliquely with respect to the holder 20 while the guide pins 11 are moved along the oblique areas 25*a* of the guide grooves 25. However, the female connector 10 is displaced only vertically along the assembling direction AD with respect to the holder 20 while the guide pins 11 are moved along the straight areas 25*b*. The female connector 10 is at an initial position (FIG. 1) where the guide pins 11 are at the open upper ends of the oblique areas 25*a* of the guide grooves 25 and is at a connecting position (FIG. 4) where the guide pins 11 are at the bottom ends of the oblique areas 25*a*. The female connector 10 moves along a transverse direction TD substantially normal to the assembling direction AD a distance that substantially corresponds to a connection or separation stroke of the connectors 10, 30 as the female connector 10 moves between the initial and connecting positions. At the initial position, a front part of the upper surface of the female connector 10 is exposed upward to the outside.

Upper and lower holding projections 26, 27 project in from the inner surface of each sidewall 22. A right end portion of the holding portion 12 of the female connector 10 is held between the holding projections 26 and 27 from above and below when the female connector 10 is at the initial position (see FIG. 6). An upwardly open shake-preventing groove 28 is formed in the inner surface of each sidewall 22.

As shown in FIGS. 1, 8 to 10, the male connector 30 is coupled to the bottom end of a mounting portion 31*a* on the instrument panel B, and has a receptacle 32 that opens laterally to the front with respect to connecting direction CD. A terminal-accommodating portion 33 is rearward of the receptacle and accommodates male terminal fittings 34 connected with unillustrated wires. Tabs 34*a* of the male terminal fittings 34 project in the receptacle 32.

A cut-out 35 is formed at a lower part 32*a* of the receptacle 32*a* toward an opening end and extends to substantially the same position as the front ends of the tabs 34*a*. The cut-out 35 permits the female connector 10 to enter into the receptacle 32 from below. Additionally, the cut-out 35 exposes an inner surface 32*b* of an upper part of the receptacle 32 downward substantially along the assembling direction AD. Thus, the front part of the upper surface of the female connector 10 that has entered the receptacle 32 can contact the inner surface 32*b*. Escaping grooves 36 are formed in the opposite sides of the receptacle 32 and open leftward along the connecting direction CD for receiving the guide pins 11 of the female connector 10. Disengagement ribs 37 project out at the bottom ends of the opposite sides of the receptacle 32 (see FIG. 8). The disengagement ribs 37 interfere with the upper holding projections 26 to press the upper holding projections 26 out in an assembling process. Thus, the opposite sidewalls 22 of the holder 20 are deformed out away from each other to disengage the holding projections 26, 27 from the holding portion 12. Further, a vertically extending shake preventing rib 38 bulges outward immediately after the escaping groove 36 at each side of the receptacle 32. The shake preventing ribs 38 enter the shake preventing grooves 28 of the holder 20 in the assembling process to suppress shaking of the male connector 30 with respect to the holder 20.

An accommodating chamber 39 extends transversely in the middle of the lower part 32*a* of the receptacle 32 of the male connector 30, and a movable protecting portion 40 is accommodated in the accommodating chamber 39 for covering the cut-out 35. This movable protecting portion 40 is displaceable with respect to the male connector 30 along the connecting direction CD of the two connectors 10, 30 between a protecting position PP where the movable protecting portion 40 covers substantially the entire cut-out 35 to protect the tabs 34*a* of the male terminal fittings 34 (see FIG. 1) and a retracted position RP where the movable protecting portion 40 is retracted from the cut-out 35 (see FIG. 2). The accommodating chamber 39 is wider than the cut-out 35. Thus, the opposite ends of the movable protecting portion 40 can be held in the cut-out portion 35 by the opposite lateral edges of the accommodating chamber 39 (see FIG. 8).

The movable protecting portion 40 is a substantially flat plate and is longer than the receptacle 32. Two resilient pieces 41 are cantilevered to the right from the right ends of the opposite widthwise sides of the movable protecting portion 40, and guide pins 42 project out at the leading ends of the resilient pieces 41 (see FIG. 9). The guide pins 42 are substantially cylindrical and are engageable with the right end edge of the accommodating chamber 39 when the movable protecting portion 40 is at the protecting position PP. Thus, the movable protecting portion 40 can be held so as not to come out leftward from the protecting position PP toward a side opposite from the retracted position RP.

The holder 20 is formed with guide grooves 29 into which the respective guide pins 42 of the movable protecting portion 40 are insertable and which open upward substantially along the assembling direction AD as shown in FIG. 1. An oblique area 29*a* is defined at an upper part of each guide groove 29 and inclines down and to the right relative to the vertical assembling direction AD. A straight area 29*b* is defined at a lower part of each guide groove 29 and extends substantially straight along the vertical direction assembling direction AD. The guide pins 42 of the movable protecting portion 40 located at the protecting position PP can enter the upper ends of the oblique areas 29*a* of the guide grooves 29. The movable protecting portion 40 is displaced to the right substantially along the connecting direction CD as the guide pins 42 are moved down along the oblique areas 29*a*. The movable protecting portion 40 is displaced to the retracted position RP when the guide pins 42 reach the bottom ends of the oblique areas 29*a* (see FIG. 2). Thus, the movable protecting portion 40 is transversely displaceable relative to the male connector 30 and with respect to the assembling direction AD between the protecting position PP and the retracted position RP in the moving process of the guide pins 42 along the oblique areas 29*a* of the guide grooves 29. The movable protecting portion 40 is not displaced relative to the male connector 30 in the moving process of the guide pins 42 along the straight areas 29*b*. The bottom ends of the oblique areas 29*a* of the guide grooves 29 are substantially at the same height as or higher than the upper surface of the female connector 10 at the initial position. Accordingly, the movable protecting portion 40 already is displaced to the retracted position RP when the upper surface of the female connector 10 reaches the movable protecting portion 40 in the assembling process to avoid mutual interference. The upper ends of the oblique areas 29*a* of the guide grooves 29 are near the back end positions of the guiding slanted surfaces 24.

A U-shaped slit is made substantially at a middle position of the movable protecting portion 40 to form a cantilever-shaped resilient locking piece 43, and a protrusion 44 at the leading end of the resilient locking piece 43 is engaged with the rear edge of the cut-out portion 35 to prevent the movable protecting portion 40 from coming out rightward from the protecting position PP and toward the retracted position RP. The resilient locking piece 43 is resiliently deformable up and down and is thinner than, most preferably about half as thick as, the movable protecting portion 40. Thus, the resilient locking piece 43 can escape into an empty space during deformation to avoid interference with the wall surface of the accommodating chamber 39. Slanted surfaces 45 are defined at the sides of the protrusion 44 so that the resilient locking piece 43 is deformed automatically to cancel the locked state when a force of a specified intensity or higher acts on the movable protecting portion 40 in the transverse direction TD. Thus, the resilient locking piece 43 and the rear edge of the cut-out 35 define a semi-locking construction. Further, an escaping groove 35*a* is formed at the rear end of the lower part 32*a* of the receptacle 32 (see FIG. 2) for receiving the protrusion 44 of the resilient locking piece 43 when the movable protecting portion 40 reaches the retracted position RP. The resilient pieces 41 and the resilient locking piece 43 are both resiliently deformable as described above. Thus, the movable protecting portion 40 can be accommodated into the accommodating chamber 39 by the resilient deformation of either the resilient pieces 41 or the resilient locking piece 43 regardless of whether the movable protecting portion 40 is accommodated from the left or right side.

The female connector 10 is accommodated into the holder 20 from a mounting side (right side in FIG. 1) to fit the guide pins 11 into the guide grooves 25. The female connector 10 is displaced obliquely up along the guide grooves 25 to a standby position so that the holding portion 12 is held between the holding projections 26, 27. Thus, the female connector 10 is held at the standby position. On the other hand, the resilient pieces 41 and/or the resilient locking piece 43 are deformed temporarily when the movable protecting portion 40 is inserted into the accommodating chamber 39 from the left or right side in the male connector 30, and then are restored when the movable protecting portion 40 reaches the protecting position PP. Thereupon, the guide pins 42 engage the right end edge of the accommodating chamber 39 and the protrusion 44 of the resilient locking piece 43 engages the rear edge of the cut-out portion 35, thereby holding the movable protecting portion 40 at the protecting position PP.

In this state, the instrument panel B is assembled with the dashboard A along the assembling direction AD as if being dropped from above. The shake preventing ribs 38 enter the shake preventing grooves 28 and the guide pins 42 of the movable protecting portion 40 are inserted into the guide grooves 29 when the male connector 30 enters the holder 20. The guide pins 42 slide down along the oblique areas 29*a* of the guide grooves 29 as the assembling proceeds. Thus, the movable protecting portion 40 is pulled rightward and substantially normal to the assembling direction AD. The resilient locking piece 43 then is guided by the slanted surface 45 of the protrusion 44, and is deformed resiliently out of engagement with the rear edge of the cut-out portion 35. Thus, the movable protecting portion 40 is moved rightward from the protecting position PP, i.e. moved relatively backward with respect to the male connector 30 toward the retracted position RP.

Figure 2:
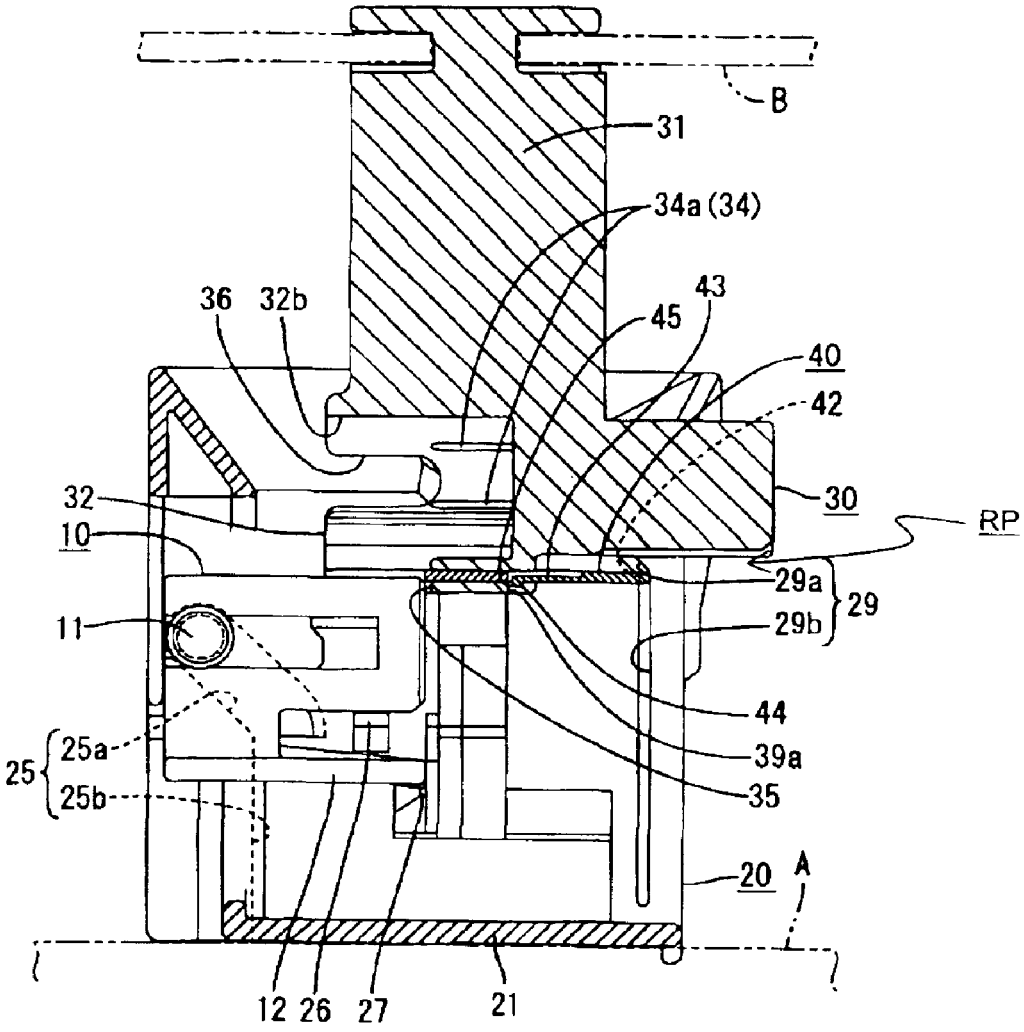
FIG. 2 is a side view in section showing a movable protecting portion that has been displaced to a retracted position in a connecting process.
Figure 3:
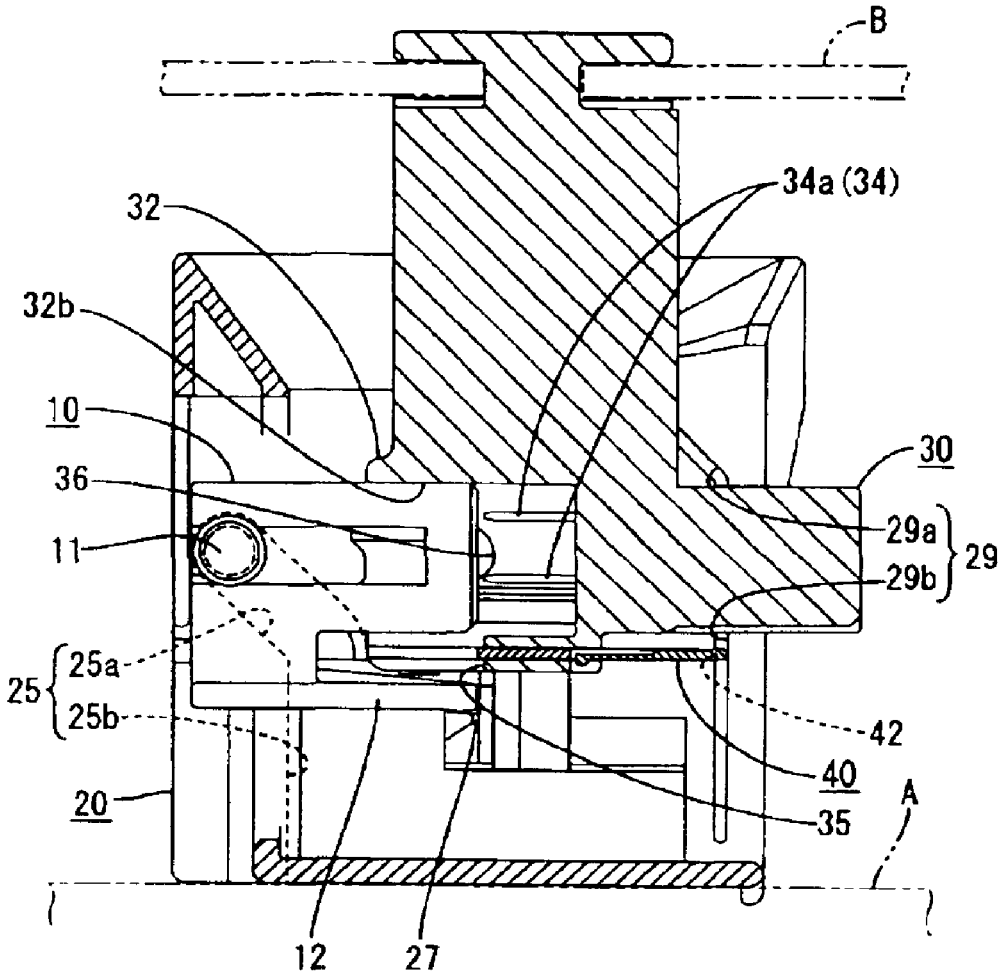
FIG. 3 is a side view in section showing the female connector in contact with an inner surface of a receptacle in the connecting process.

The guide pins 42 reach the bottom ends of the oblique areas 29*a* of the guide grooves 29 and the movable protecting portion 40 is moved back to the retracted position RP to open substantially the entire cut-out 35 when the upper surface of the female connector 10 reaches a position near the lower surface of the movable protecting portion 40, as shown in FIG. 2. Thus, the female connector 10 can enter the receptacle 32 without interfering with the movable protecting portion 40. At this time, the resilient locking piece 43 is restored resiliently by the protrusion 44 that escapes into the escaping groove 39*a*. When the assembling further proceeds in this state, the upper surface of the female connector 10 contacts the inner surface 32*b* of the upper part of the receptacle 32 as shown in FIG. 3. At this time, the disengagement ribs 37 press the upper holding projections 26 out in a disengagement direction, and the opposite side walls 22 of the holder 20 are deformed out away from each other to disengage the holding projections 26, 27 from the holding portion 12. As a result, a relative displacement of the female connector 10 with respect to the holder 20 is permitted.

Figure 4:
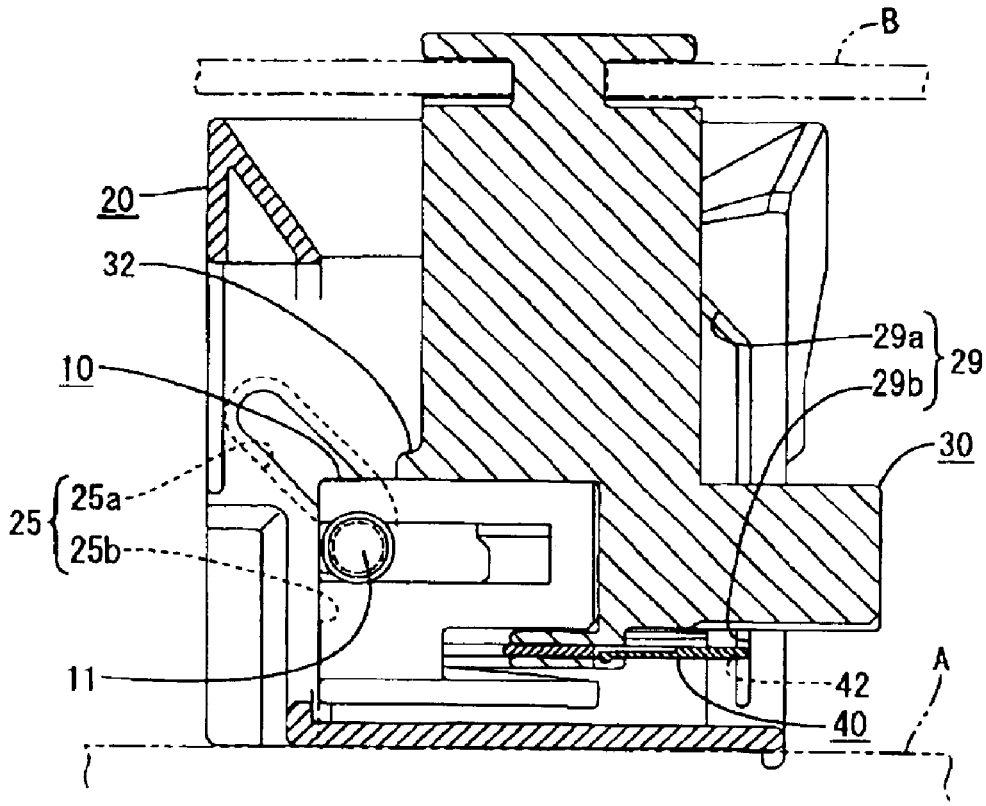
FIG. 4 is a side view in section showing a state where the male and female connectors are connected properly.
Figure 5:
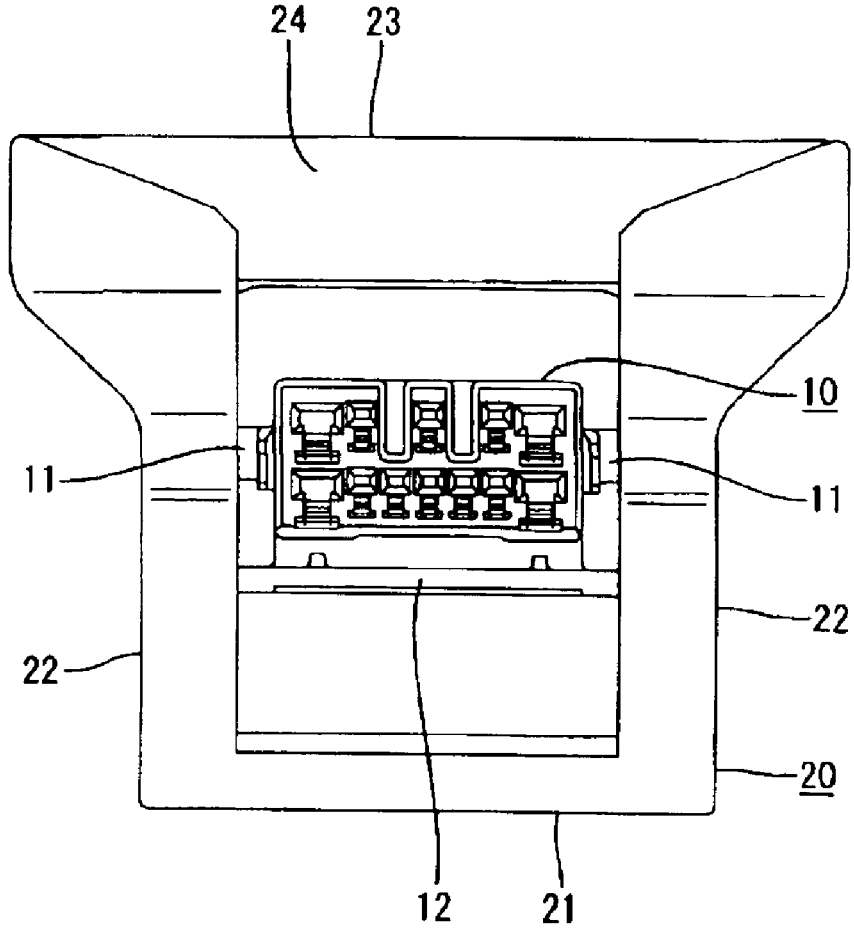
FIG. 5 is a front view of a holder having the female connector assembled at an initial position.
Figure 6:
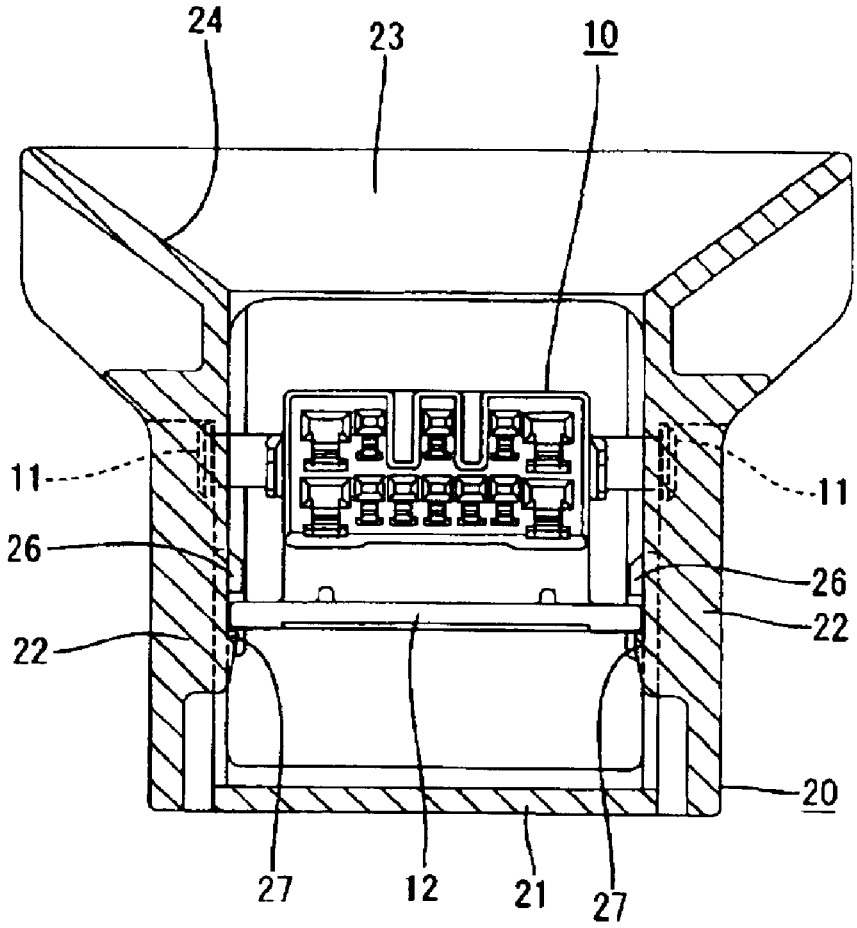
FIG. 6 is a section along 6—6 of FIG. 5.
Figure 7:
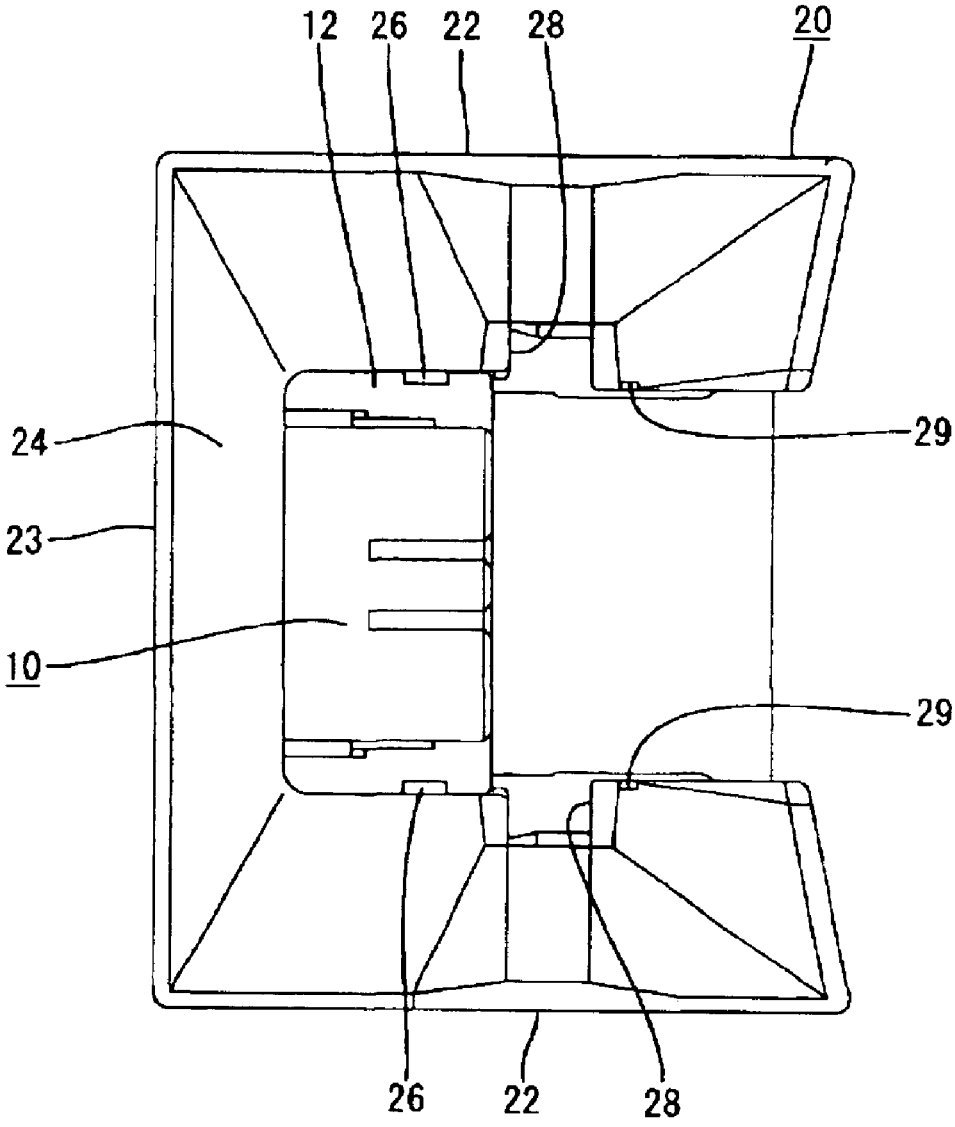
FIG. 7 is a plan view of the holder having the female connector assembled at the initial position.
Figure 8:
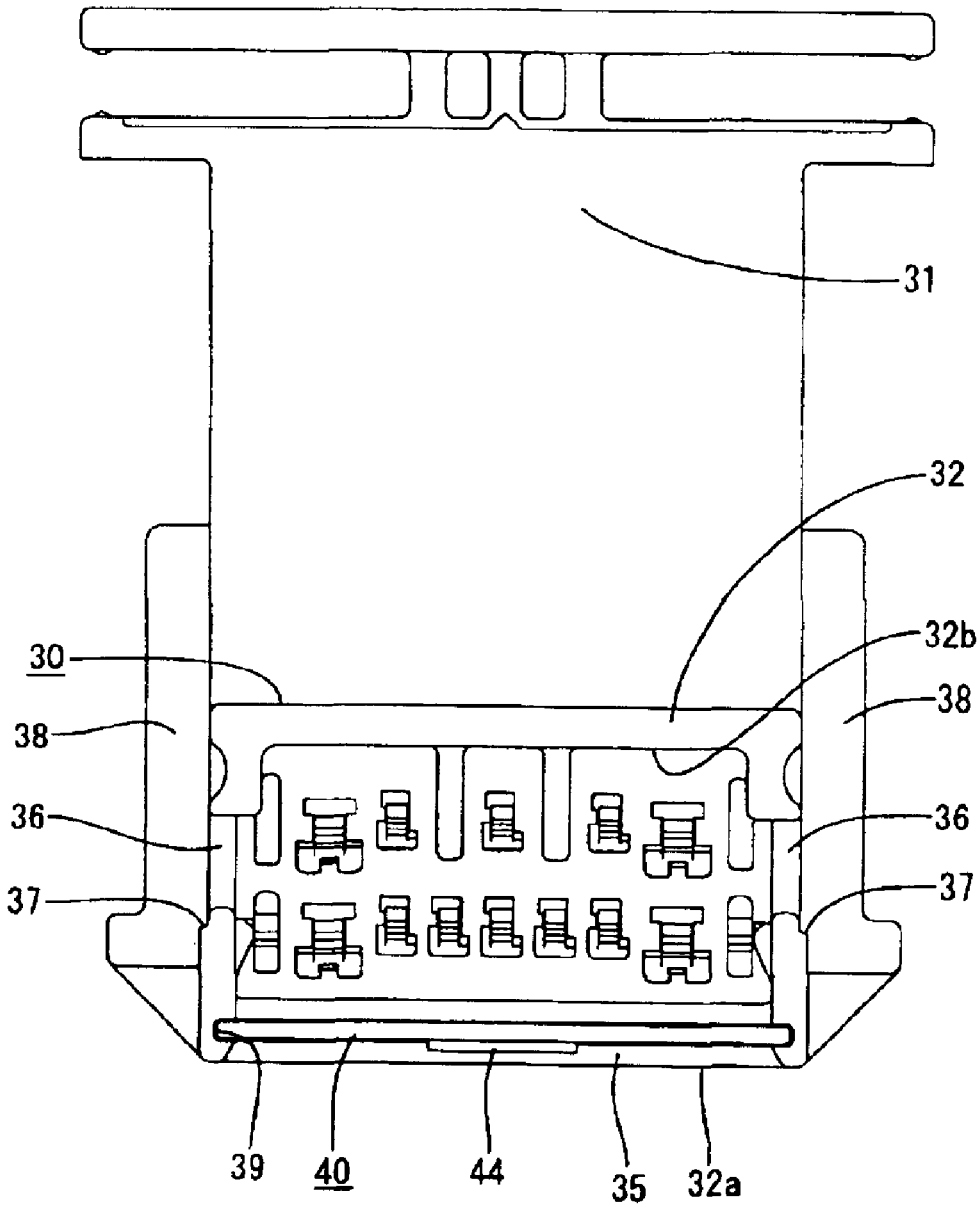
FIG. 8 is a front view of the male connector.
Figure 9:
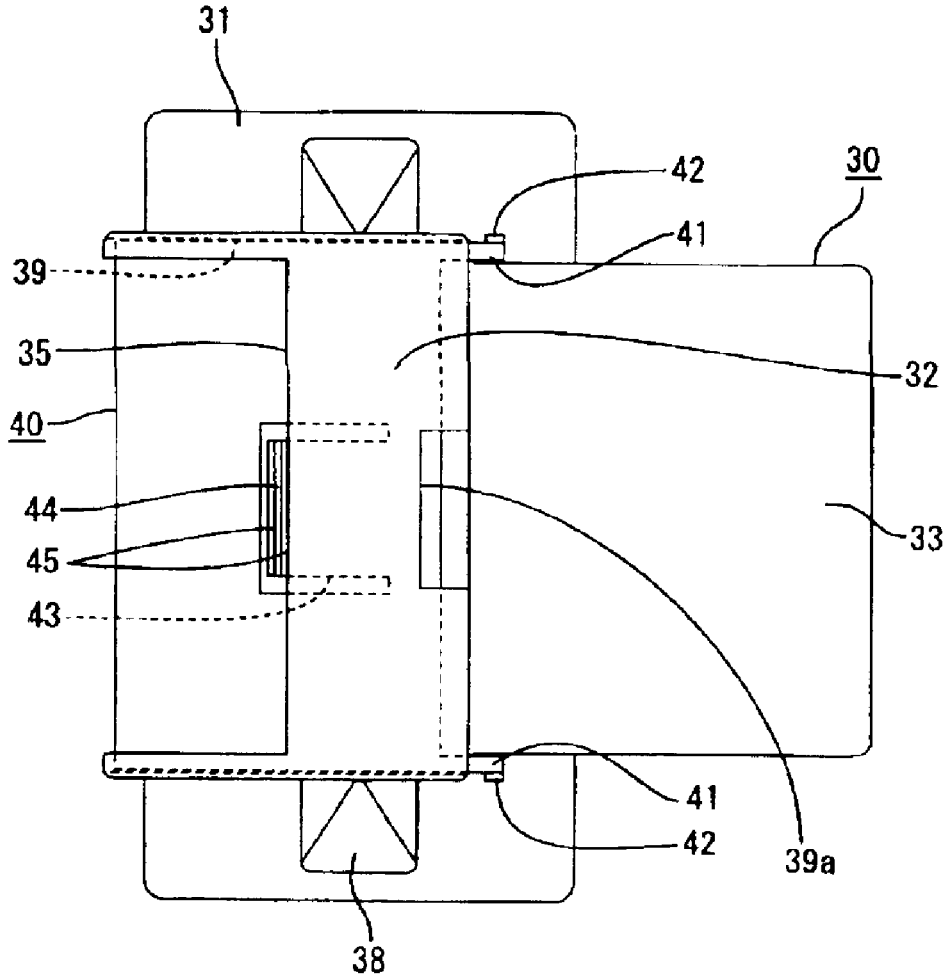
FIG. 9 is a bottom view of the male connector.
Figure 10:
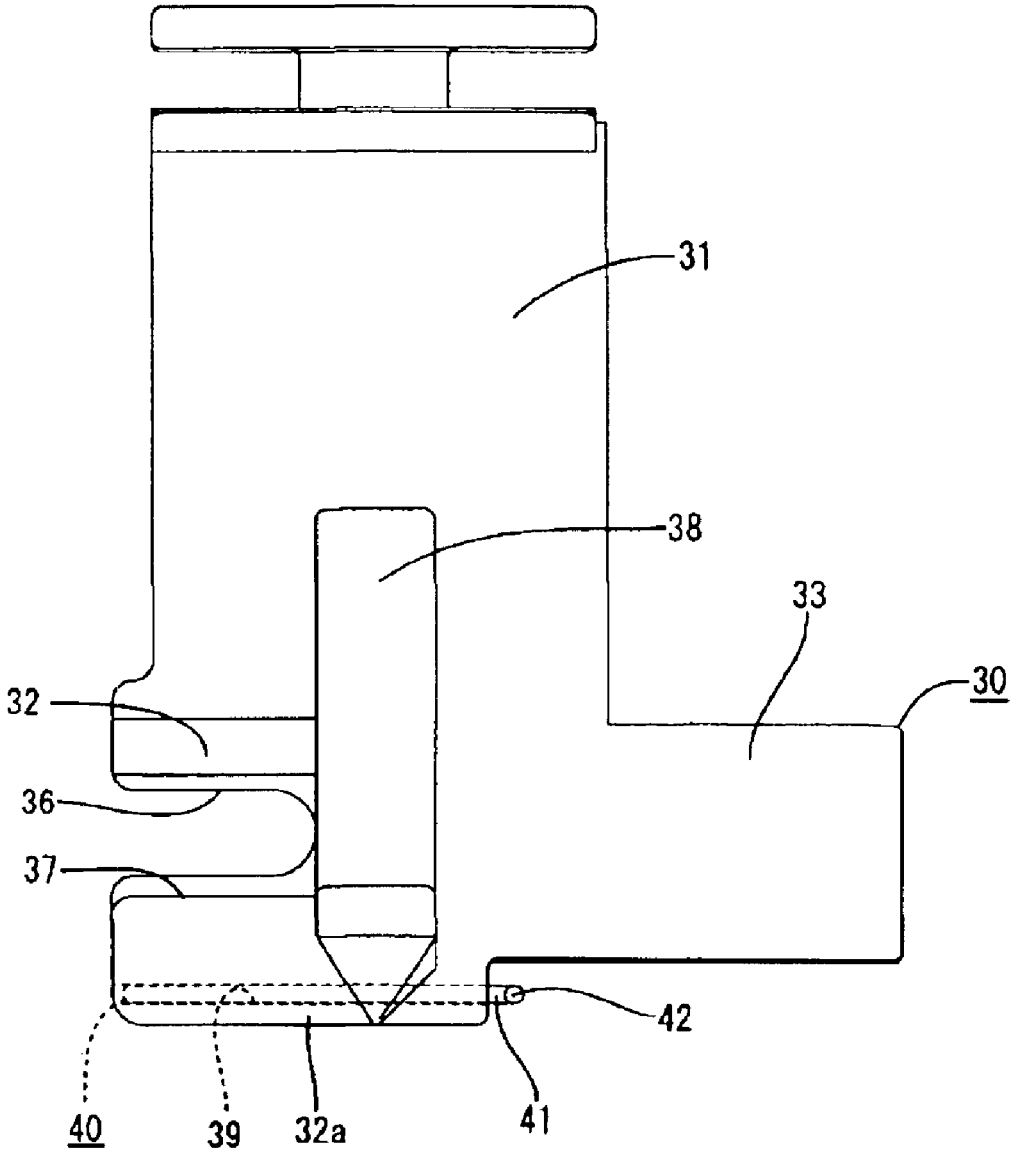
FIG. 10 is a side view of the male connector.
Figure 11:
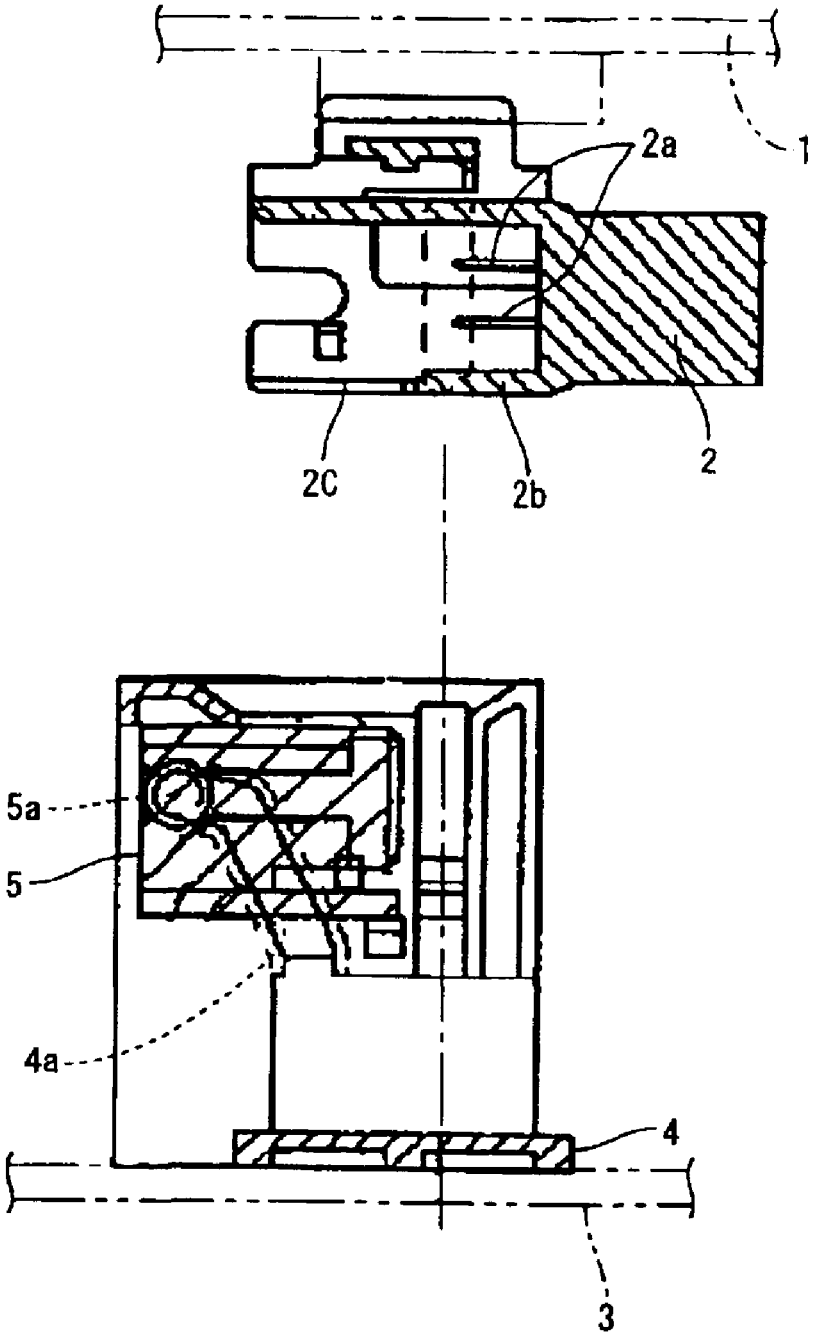
FIG. 11 PRIOR ART
FIG. 11 is a side view in section showing a state before male and female connectors according to a prior art are connected.
Figure 12:
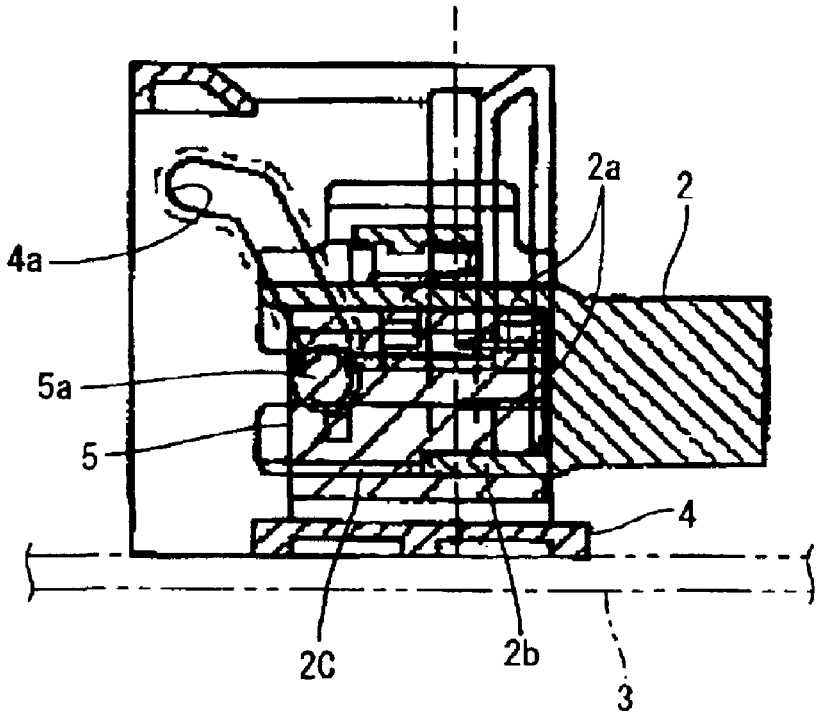
FIG. 12 PRIOR ART
FIG. 12 is a side view showing a state where the male and female connectors according to the prior art are connected.

The female connector 10 is pushed down in the assembling direction AD with respect to the holder 20 by the inner surface 32*b* of the receptacle 32 as the assembly proceeds. At this time, the guide pins 11 slide down along the oblique areas 25*a* of the guide grooves 25, and the female connector 10 is displaced rightward along the connecting direction CD and towards the connecting position from the initial position. Thus, the female connector 10 is displaced in the receptacle 32 to approach the male connector 30 along the connecting direction CD. The female connector 10 is displaced to the connecting position when the guide pins 11 reach the bottom ends of the oblique areas 25*a* and is connected to a substantially proper depth in the receptacle 32 to connect the male and female terminal fittings electrically. In this state, the assembling of the instrument panel B and the dashboard A is not completed yet. The assembling proceeds further so that the guide pins 11, 42 slide along the straight areas 25*b*, 29*b* of the guide grooves 25, 29, as shown in FIG. 4, and the female connector 10 and the movable protecting portion 40 are displaced down along the assembling direction AD without being displaced along the connecting direction CD from the connecting position and the retracted position RP. Thus, an assembling error of the dashboard A and the instrument panel B can be taken up.

The two connectors 10, 30 may have to be detached for maintenance or other reason. The instrument panel B is pulled up from the dashboard A in the state shown in FIG. 4. The guide pins 11 of the female connector 10 then slide up along the oblique areas 25*a* of the guide grooves 25. As a result, the female connector 10 is displaced leftward along the connecting direction CD in a detachment direction (toward the initial position) so that the receptacle 32 is separated from the male connector 30. In this way, the two connectors 10, 30 are separated and the male and female terminal fittings are separated (see FIG. 3). The detachment further proceeds after the guide pins 11 of the female connector 10 reach the upper ends of the guide grooves 25. As a result, the female connector 10 reaches the initial position and comes out downward from the receptacle 32 through the cut-out 35 (see FIG. 2). At this time, the guide pins 42 of the movable protecting portion 40 have already reached the bottom ends of the oblique areas 29*a* of the guide grooves 29. Thus, the guide pins 42 slide up along the oblique areas 29*a* when the detachment further proceeds, with the result that the movable protecting portion 40 is displaced leftward along the connecting direction CD toward the protecting position PP from the retracted position RP. The movable protecting portion 40 is returned to the protecting position PP where the guide pins 42 are at the upper ends of the guide grooves 29 and the movable protecting portion 40 covers the cut-out portion 35 when the male connector 30 is detached from the holder 20.

As described above, the movable protecting portion 40 for covering the cut-out portion 35 is assembled into the male connector 30 and is displaced from the protecting position PP to the retracted position RP by the guide pins 42 and guide grooves 29 to permit entry of the female connector 10 through the cut-out portion 35. Thus, the receptacle 32 can be shorter as compared to a case where the tabs 34*a* of the male terminal fittings 34 are protected by elongating the receptacle 32. Therefore, the connection stroke of the two connectors 10, 30 can be shortened and the connectors can be smaller.

Further, the guide pins 42 are engaged with the male connector 30 with the movable protecting portion 40 located at the protecting position PP, thereby preventing the movable protecting portion 40 from being displaced toward the side opposite from the retracted position RP. The guide pins 42 have both a function of displacing the movable protecting portion 40 and a function of holding the movable protecting portion 40. Thus, the construction can be simplified as compared to, for example, a case where two exclusive parts are provided to carry out the respective functions.

Further, the movable protecting portion 40 can be prevented from being displaced from the protecting position PP toward the retracted position RP by the engagement of the resilient locking piece 43 formed in the movable protecting portion 40 with the rear edge of the cut-out 35. Furthermore, the locking construction of the resilient locking piece 43 and the cut-out 35 is a semi-locking construction. Thus, the locked state is canceled automatically when a force of a specified intensity or higher acts to cause the protecting-portion guiding means to displace the movable protecting portion 40 toward the standby position, resulting in better operability.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the guide pins provided on the movable protecting portion have the function of holding the movable protecting portion in the foregoing embodiment, a holding portion having such a holding function may be provided separately from the guide pins according to the present invention.

Although the protrusion of the resilient locking piece is formed with the one or more slanted or rounded surfaces in the foregoing embodiment, a similar slanted or rounded surface may be formed alternatively or additionally at the rear edge of the cut-out portion. The locking construction of the resilient locking piece may be a usual locking construction (both locking surfaces are substantially straight surfaces substantially normal to a force acting direction) instead of being a semi-locking construction according to the present invention.

Although the male terminal fittings are at least partly accommodated in the male connector in the foregoing embodiment, the present invention is also applicable, for example, to a case where a printed circuit board is at least partly accommodated in the male connector.

Although the holder and the female connector are provided at the dashboard side and the male connector is provided at the instrument panel side in the foregoing embodiment, a reversed arrangement may be taken according to the present invention.

Although the meter module (assembling member of the vehicle body is the instrument panel and the one of an electrical module is the dashboard) is described in the foregoing embodiment, the present invention is not limited to application to automotive meter modules and may be applied to door modules (assembling member of the vehicle body is a door panel and the one of an electrical module is an inner panel), overhead modules (assembling member of the vehicle body is a roof panel and the one of an electrical module is an inner panel) or the like.

What is claimed is:

1. A connector connecting construction, comprising at least a pair of assembling members to be assembled with each other, a first assembling member being provided with a first connector and a second assembling member being provided with a second connector connectable with the first connector, wherein:

the second connector comprises a receptacle extending in a direction at an angle to an assembling direction of the two assembling members and formed with at least one cut-out for permitting the first connector to enter the receptacle and contact an inner surface of the receptacle in an assembling process, and a connecting portion projecting into the receptacle and electrically connectable with the first connector, the first connector being assembleable with a holder fixed to the first assembling member via a connector guiding means and relatively displaceable with respect to the second connector in a direction at an angle to the assembling direction by the connector guiding means upon being pushed by the inner surface of the receptacle in the assembling process, and a movable protecting portion for at least partly covering the cut-out being assembled with the second connector and the movable protecting portion and the holder comprising protecting-portion guiding means for displacing the movable protecting portion from a protecting position where the movable protecting portion at least partly covers the cut-out to a retracted position where the movable protecting portion is retracted from the cut-out to permit the entrance of the first connector through the cut-out as the two assembling members are assembled.

2. The connector connecting construction of claim 1, wherein the protecting-portion guiding means comprises at least one guide pin provided on the movable protecting portion and at least one guide groove formed in the holder and permitting the guide pin to slide therealong to displace the movable protecting portion between the protecting position and the retracted position.

3. The connector connecting construction of claim 2, wherein the guide pin can prevent the movable protecting portion located at the protecting position from being displaced toward a side opposite from the retracted position by being engaged with the second connector.

4. The connector connecting construction of claim 1, wherein resilient locking means is provided on at least one of the movable protecting portion and the second connector for preventing the movable protecting portion located at the protecting position from being displaced toward the retracted position.

5. The connector connecting construction of claim 4, wherein a locking construction of the resilient locking means and the second connector is a semi-locking construction whose locked state is canceled when a force of a specified intensity or higher acts to cause the protecting-portion guiding means to displace the movable protecting portion toward the retracted position.

6. The connector connecting construction of claim 1, wherein shake preventing means are provided on at least one of the holder and the second connector to suppress shake of the second connector with respect to the holder during the assembling process.

7. The connector connecting construction of claim 1, wherein the first connector is movable between an initial position and a connecting position for connection with the second connector.

8. The connector connecting construction of claim 7, wherein a moving distance of the first connector along a direction arranged at an angle to the assembling direction substantially corresponds to a connection or separation stroke of the two connectors.

9. A method of connecting a connector, comprising the following steps:

providing at least a pair of assembling members to be assembled with each other, a first assembling member being provided with a first connector and a second assembling member being provided with the a second connector connectable with the first connector, inserting the first connector into a receptacle of the second connector that extends in a direction at an angle to an assembling direction of the two assembling members, wherein the first connector is permitted to enter the receptacle through at least one cut-out and to contact an inner surface of the receptacle in an assembling process, assembling the first connector with a holder fixed to the one assembling member via a connector guiding means, wherein the holder is relatively displaceable with respect to the second connector in a direction at an angle to the assembling direction by the connector guiding means upon being pushed by the inner surface of the receptacle in the assembling process, at least partly covering the cut-out by a movable protecting portion being assembled with the first connector and the movable protecting portion and/or the holder, and displacing the movable protecting portion by protecting-portion guiding means from a protecting position where the movable protecting portion covers the cut-out to a retracted position where the movable protecting portion is substantially retracted from the cut-out to permit entrance of the first connector through the cut-out as the two assembling members are assembled.

10. The method of claim 9, wherein the movable protecting portion displacing step comprises a step of guiding the movable protecting portion between the protecting position and the retracted position by means of at least one guide pin on the movable protecting portion and at least one guide groove in the holder.

11. The method of claim 10, wherein the guide pin can prevent the movable protecting portion located at the protecting position from being displaced toward a side opposite from the retracted position by being engaged with the second connector.

* * * * *